United States Patent [19]

Doss

[11] 4,411,323

[45] Oct. 25, 1983

[54] GRADING MACHINE

[76] Inventor: Harry L. Doss, Hill Church Rd., Tifton, Ga. 31794

[21] Appl. No.: 282,509

[22] Filed: Jul. 13, 1981

[51] Int. Cl.[3] ..... E02F 3/76

[52] U.S. Cl. ..... 172/799.5; 172/459

[58] Field of Search ..... 172/780, 799.5, 791, 172/796, 797, 445.2, 477, 459, 460, 478

[56] References Cited

U.S. PATENT DOCUMENTS

| | | | |
|---|---|---|---|
| 1,501,892 | 7/1924 | Dunning | 172/799.5 |
| 1,928,778 | 10/1933 | Austin | 172/799.5 |
| 2,142,985 | 1/1939 | Arndt | 172/799.5 |
| 2,197,390 | 4/1940 | Arndt . | |
| 2,567,805 | 9/1951 | Doerfler | 172/799.5 |
| 3,172,480 | 3/1965 | Bemis | 172/799.5 |
| 3,302,317 | 2/1967 | Domres | 172/799.5 |
| 3,376,937 | 4/1968 | Groberg . | |
| 3,428,133 | 2/1969 | Young et al. . | |
| 3,608,643 | 9/1971 | Flood et al. | 172/799.5 |
| 3,724,557 | 4/1973 | Boschung | 172/780 |
| 3,776,318 | 12/1973 | Layton | 172/799.5 X |

FOREIGN PATENT DOCUMENTS

| | | | |
|---|---|---|---|
| 576369 | 10/1977 | U.S.S.R. | 172/799.5 |

*Primary Examiner*—Richard J. Johnson

*Attorney, Agent, or Firm*—Schuyler, Banner, Birch, McKie & Beckett

[57] ABSTRACT

A grading machine (10) is disclosed. The grading machine (10) includes a main frame (14), a center frame (16), and a rear frame (18). A grading blade (20) is connected to the main frame (14) for pivotable motion about a vertical axis. A pair of spaced wheels (22) is carried by the rear frame (18). The tilt of the blade (20) can be adjusted by rotating the center frame (16) and the main frame (14) connected thereto about a horizontal axis extending in the direction of travel of the machine (10). The height of the blade (20) can be adjusted by adjusting the angular relationship between the center frame (16) and the main frame (14) about a second horizontal axis of a coupling rod (96).

19 Claims, 3 Drawing Figures

10
12
14
16
18
20
22
24
26
28
30
32
34
36
38
44
46
48
50
52
54
56
58
60
62
64
66
68
70
72
74
76
78
80
82
83
84
86
87
88
90
92
94
96
98
100
102
104
106
108
110
112
114
116
118
120
122
124
126

GRADING MACHINE

TECHNICAL FIELD

The present invention relates broadly to a ground working machine. More particularly, the invention relates to a grading machine adapted to be towed by a motorized vehicle, such as a tractor or a motor-driven grader.

BACKGROUND OF THE INVENTION

Numerous grading machines are known in the prior art. An example of a motor-driven grading machine is illustrated in U.S. Pat. No. 3,776,318 issued to Layton on Dec. 4, 1973. The machine illustrated in the '318 patent utilizes a grader or scraper blade means carried by a motor-driven vehicle. The blade means includes a pair of blade sections disposed end-to-end and pivotably connected at their adjacent ends. The blade sections can thus be pivoted to produce either a crown or a valley in the area being worked.

An example of a towed grading machine is disclosed in U.S. Pat. No. 3,608,643 issued to Flood et al on Sept. 28, 1971. The grading machine illustrated in the '643 patent utilizes a grading blade pivotably attached to a frame about a vertical axis. A pair of laterally spaced wheels are connected to the blade through short beams which are connected to the blade through horizontal and vertical pivots. Separate hydraulic piston and cylinder devices are provided for turning the grading blade about its vertical pivot axis to adjust the angular disposition of the grading blade and for pivoting the short wheel carrying beams about their horizontal and vertical pivots to thereby adjust the height of the blade and steer the grader. Tilting of the grading blade is mentioned, however, no mechanism for accomplishing this function is disclosed.

Other towed grading machines are illustrated in U.S. Pat. No. 2,142,985 issued to Arndt on Jan. 10, 1939; U.S. Pat. No. 2,197,390 issued to Arndt on Apr. 16, 1940; U.S. Pat. No. 3,376,937 issued to Groberg on Apr. 9, 1968; and U.S. Pat. No. 3,428,133 issued to Young et al on Feb. 18, 1969.

SUMMARY OF THE INVENTION

A grading machine comprised of a main frame, a center frame and a rear frame is disclosed. The center frame is pivotably coupled to the main frame about a generally horizontal axis extending in a first direction. The center frame is also pivotably coupled to the rear frame for motion about a second generally horizontal axis extending in a direction transverse to the first direction. A grading blade is connected to the main frame for pivotable motion about a vertical axis, and ground contact means are carried by the rear frame.

In a preferred embodiment, a first hydraulic cylinder is utilized to pivot the main frame about the first horizontal axis to thereby adjust the vertical height of the grading blade with respect to the ground and the rear frame. A second hydraulic cylinder pivots the main frame about the second horizontal axis to adjust the tilt of the grading blade. A third hydraulic cylinder is used to adjust the angular disposition of the grading blade by pivoting the blade about its vertical pivot axis. A pair of laterally spaced wheels serve as the ground contact means and are controlled by a fourth hydraulic cylinder to steer the grading machine.

The utilization of the articulated frames, controlled by the hydraulic cylinders, results in a grader of relatively simple construction wherein a plurality of adjustments necessary for optimum functioning of a grading machine can be reliably performed. The grading machine or tail grader is capable of offsetting its blade disposition behind a motorized grader to a sufficient degree so that complete grading of a typical road bed can be accomplished in a single pass. Fuel savings occur where the number of passes by the motorized grader are reduced.

Various advantages and features of novelty which characterize the invention are pointed out with particularity in the claims annexed hereto and forming a part hereof. However, for a better understanding of the invention, its advantages, and objects obtained by its use, reference should be had to the drawings which form a further part hereof, and to the accompanying descriptive matter, in which there is illustrated and described a preferred embodiment of the invention.

DETAILED DESCRIPTION OF THE INVENTION

Figure 1:
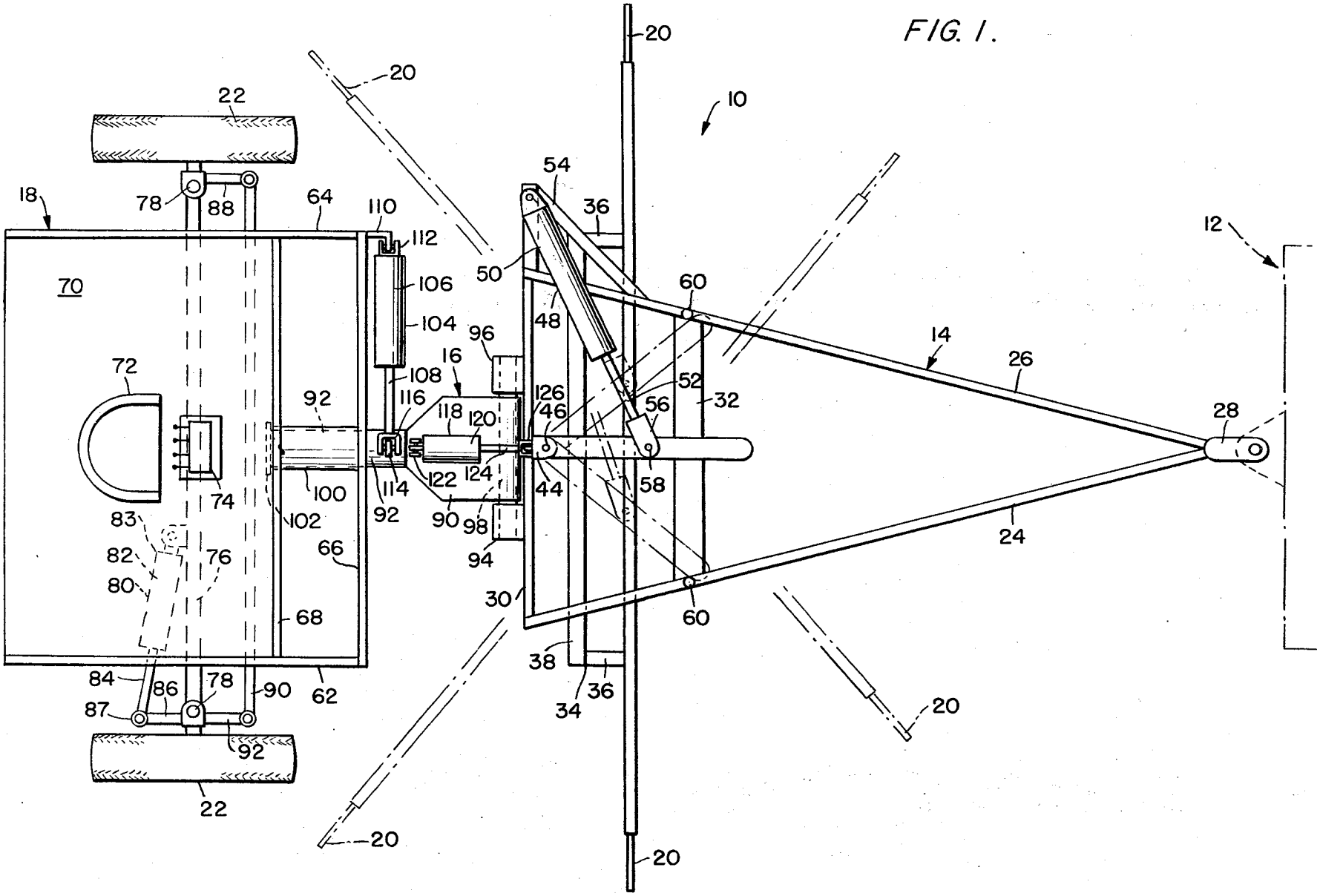
FIG. 1 is a top plan view of a grading machine in accordance with the present invention.
Figure 2:
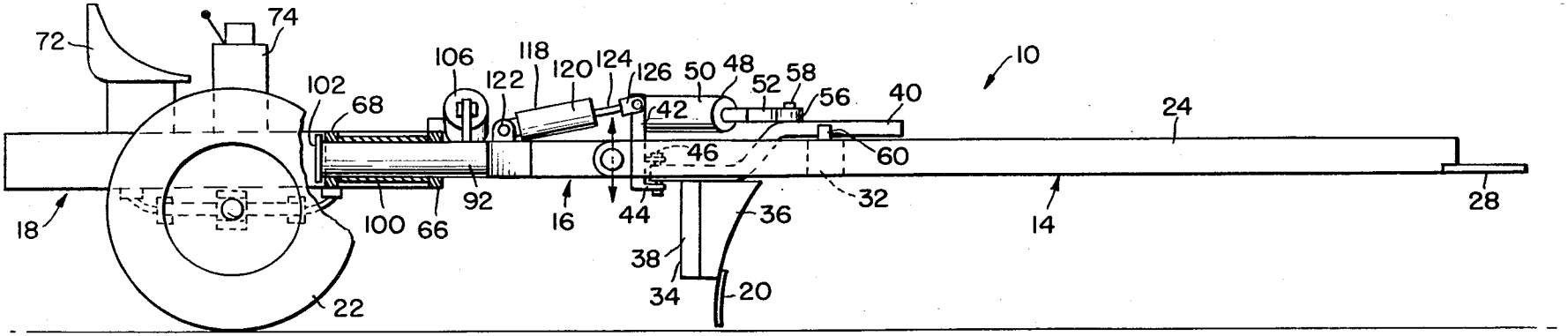
FIG. 2 is a side elevational view of the grading machine.
Figure 3:
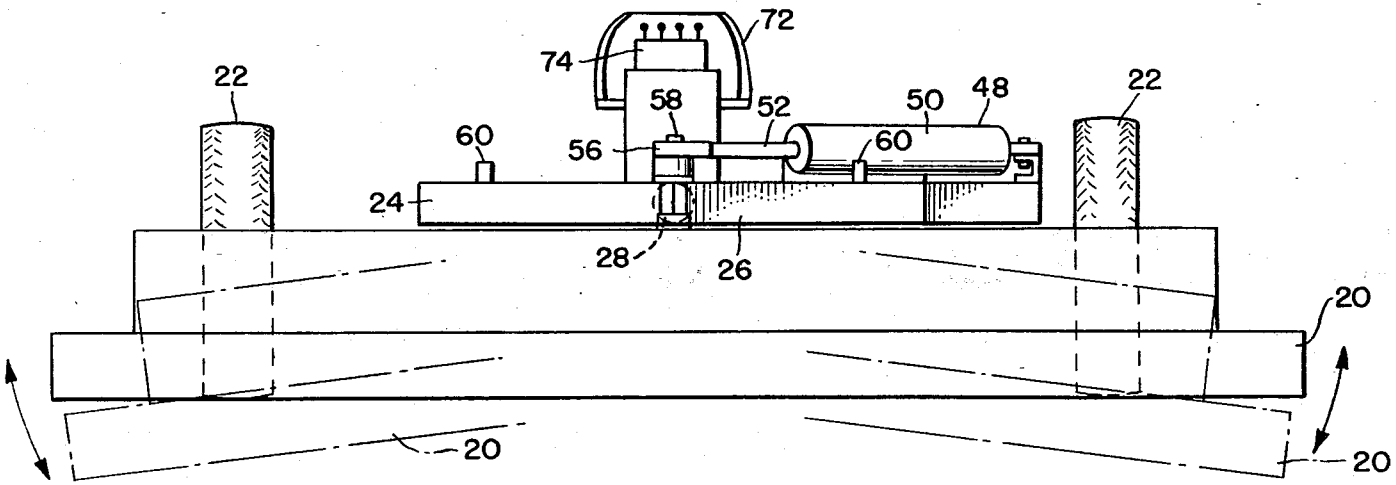
FIG. 3 is a front elevational view of the grading machine.

Referring to the drawings in detail wherein like numerals indicate like elements, there is shown in FIG. 1 a grading machine or tail grader designated generally as 10. The grading machine 10 is designed to be towed by a motorized vehicle, such as a motorized grader or tractor, illustrated diagramatically in phantom line as 12. The grading machine 10 includes a main frame 14, a center frame 16 and a rear frame 18. A grading blade 20 is supported by the main frame 14, and a pair of ground contacting wheels 22 are rotatably carried by the rear frame 18.

The main frame 14 takes on a generally wedge or V-shape. The main frame 14 includes a pair of side members 24, 26 which converge from the rear toward the front and are connected together at their forward most end by a hitch plate 28. The hitch plate 28 is used to connect the machine 10 to the motorized vehicle 12. A transverse connecting bar or brace 30 extends between the rear most ends of the side members 24, 26. A second transverse cross bar or brace 32 extends between the side members 24, 26 at a location forward of the first brace 30.

A blade frame 34 pivotably connects the blade 20 to the main frame 14. The blade frame 34 includes a pair of spaced, forwardly extending connecting members 36, a transversely extending connecting member 38, and a control arm 40. The connecting members 36 are attached directly to the blade 20 and the connecting member 38 extends between the two members 36. The control arm 40 is fixedly attached to the top surface of the transverse connecting member 38 and is disposed perpendicular thereto.

An arm 42 is attached to the center of the cross brace 30 and extends vertically therefrom. The arm 42 has a yoke 44 extending forwardly from its lower end. A first rearward end of the control arm 40 is pivotably coupled to the yoke 44 by passing a pin 46 through apertures in the yoke 44 and the control arm 40. The control arm 40 is bent so that its rearward portion is vertically lower than its forward portion. The forward portion of the control arm 40 has a lower surface which rests upon and is in sliding contact with the upper surface of the cross brace 32. In this manner, the control arm 40 and the blade 20 is suspended from the main frame 14.

A first hydraulic cylinder device 48 provides the power for swinging the arm 40 about the axis of the pin 46 to thereby change the angular disposition of the blade 20, as shown in phantom lines in FIG. 1. The device 48 includes a cylinder 50 to which pressurized hydraulic fluid is supplied, and a piston rod 52 extending from the cylinder and movable in response to the pressurized fluid supplied to the cylinder 50. One end of the cylinder 50 is pivotably attached to an extension 54 which extends laterally from one side of the main frame 14. A connecting plate 56 is attached to the distal end of the piston rod 52 and is pivotably connected to a pin 58 which extends from the upper surface of the control arm 40. The extension and contraction of the piston rod 52 moves the control arm 40 between the extreme left and right positions shown in phantom line in FIG. 1. A stop pin 60 extends from the upper surface of each side member 24, 26 to stop the motion of the control arm 40 at either of its extreme positions. The motion of the control arm 40 moves the grading blade 20 between its extreme angular positions, also shown in phantom line in FIG. 1.

The rear frame 18 includes a pair of side members 62, 64 and a pair of spaced parallel cross bars 66, 68 extending between the side members 62, 64 adjacent their forward end. A deck 70 is attached between the side members 62, 64 and extends rearward of the cross bar 68. A seat 72 and a hydraulic control panel 74 are carried on the deck 70. The control panel 74 houses a plurality of hand operated control valves for controlling the hydraulic cylinder device 48 and the hydraulic devices described hereinafter. For purposes of clarity, the various hydraulic supply lines between a pressurized hydraulic fluid source, the control valves and the various hydraulic cylinder devices are not shown.

A pair of laterally spaced wheels 22 are rotatably carried on an axle 76 which is attached to the lower surface of the rear frame 18. Each wheel 22 is attached to a vertical pivot 78 carried by the axle 76. A second hydraulic cylinder device 80, comprised of a cylinder 82 and a retractable piston rod 84 is provided for steering the wheels 22. One end 83 of the cylinder 82 is pivotably attached to the axle 22 and a distal end 87 of the piston rod 84 is pivotably connected to a control rod 86. The control rod 86 is connected to one of the wheels 22 to pivot it about its vertical pivot 78. A control rod 88 is connected to the other wheel 22 for pivoting it about its vertical pivot 78 and is coupled to the first vertical pivot 78 by means of a linkage system comprised of a tie rod 90 and a connecting rod 92. In this manner, the two wheels 22 can be turned in unison.

The center frame 16 is comprised of a plate 90 and a tubular member 92. An ear 94 extends rearwardly from the cross brace 30 adjacent one side of the plate 90 and a second ear 96 extends rearwardly from the cross brace 30 adjacent an opposite side of the plate 90. The ears 94, 96 have aligned apertures for reception of a coupling rod 98. The plate 90 similarly has an opening or aperture for receiving the rod 98. In this manner, the plate 90 is coupled to the main frame 14 for pivoting about a generally horizontal first axis defined by the rod 98.

A hollow cylinder 100 is attached between facing vertical surfaces of the cross bars 66, 68 and is aligned with openings formed in the bars 66, 68. The tubular member 92 extends through the openings in the cross bars 66, 68 and through the hollow cylinder 100. A stop 102 is affixed to the distal end of the tubular member 92 rearward of the cross bar 68 so as to limit the forward motion of the tubular member 92 relative to the rear frame 18. The tubular member 92 is freely rotatable within the cylinder 100 about a second generally horizontal axis perpendicular to the axis of coupling rod 96.

A third hydraulic cylinder device 104, comprised of a cylinder 106 and a retractable piston rod 108, provides the power for rotating the tubular member 92 and, hence, the main frame 14 with respect to the rear frame 18. Such motion adjusts the tilt of the grading blade 20. A right angle extension 110 is attached to one side of the cross bar 66. An end of the cylinder 106 is pivotably connected to the right angle extension 110 by means of a yoke assembly 112. A distal end of the piston rod 108 is pivotably attached to a lever arm 114 by a yoke assembly 116. The lever arm 114 is fixed to and extends upwardly from the outer surface of the tubular member 92. The point of pivotable attachment of the yoke 116 to the arm 114 is located a distance above the outer surface of the tubular member 92 to create leverage for tilting the blade 20.

A fourth hydraulic cylinder device 118 is coupled between the plate 90 and the main frame 14 for changing the angular relationship between the center frame 16 and the main frame 14 to thereby raise and/or lower the blade 20 to adjust the depth of the grade or cut made by the blade 20. The device 118 includes a cylinder 120 pivotably connected to an upper surface of the plate 90 by a yoke assembly 122, and a retractable piston rod 124 pivotably connected to the main frame 14 through a yoke assembly 126 coupled to an upper end of the arm 42.

The operation of the machine 10 should be self evident from the above description and, hence, will be only briefly summarized. The machine 10 is connected to a motorized vehicle 12 through the hitch plate 28. The angle at which the blade 20 is to grade is set by adjusting the first hydraulic cylinder device 48. The amount of offset at which the machine is to travel with respect to the motorized vehicle 12 is set by steering the wheels 22. The depth at which the blade 20 will grade can be set by adjusting the fourth hydraulic cylinder device 118. If the grade is to tilt to one side or the other, the hydraulic cylinder device 104 can set such tilt. The machine 10 is towed by the motorized vehicle 12 and any of the above adjustments can be made by an operator during grading by adjusting the appropriate control valves on the hydraulic control panel 74.

Numerous characteristics and advantages of the invention have been set forth in the forgoing description, together with details of the structure and function of the invention, and the novel features thereof are pointed out in the appended claims. The disclosure, however, is illustrative only, and changes may be made in detail, especially in matters of shape, size and arrangement of parts, within the priciple of the invention, to the full extent indicated by the broad general meaning of the terms in which the appended claims are expressed.

I claim:

1. A grading machine comprising a main blade support frame, a center connecting frame and a rear wheel support frame, said main frame extending longitudinally between a forward and a rearward end and having means for coupling the forward end to a vehicle, said center connecting frame being pivotably coupled to the rearward end of said main frame about a generally horizontal axis extending in a first direction transverse to the longitudinal direction of said main frame, and said center frame being pivotably coupled to said rear frame for motion about a second generally horizontal axis extending in said longitudinal direction whereby said rear wheel support frame is coupled to said main blade support frame for pivotal motion about two generally horizontal axes perpendicular to one another by way of said separate center connecting frame, a grading blade, means for connecting said grading blade to said main frame for pivoting motion about a vertical axis, ground contacting wheels carried by said rear wheel support frame, first powered means coupled between said main and center frames for pivoting said main frame about said first horizontal axis to adjust the vertical height of said grading blade with respect to the ground and said rear frame, and second powered means coupled between said rear and center frames for pivoting said main frame about said second horizontal axis to adjust the tilt of said grading blade.

2. A grading machine in accordance with claim 1 wherein said center frame includes a rearwardly extending tubular member and said rear frame includes a hollow cylindrical member within which said tubular member is rotatably received.

3. A grading machine in accordance with claim 2 wherein said second powered means includes a hydraulic cylinder device having a first end pivotably connected to said rear frame and a second end pivotably connected to said center frame, and means for controlling the application of pressurized hydraulic fluid to said cylinder device to control the rotary position of said tubular member with respect to said cylindrical member whereby the tilt of said grading blade is controlled.

4. A grading machine in accordance with claim 1, 2 or 3 wherein said first powered means includes includes a second hydraulic cylinder device having a first end pivotably connected to said center frame and a second end pivotably connected to said main frame, and means for controlling the application of pressurized hydraulic fluid to said second hydraulic cylinder device to control the pivotal relationship between said main frame and said center frame whereby the vertical position of said grading blade is controlled.

5. A grading machine in accordance with claim 1, 2 or 3 wherein said means for connecting said grading blade to said main frame includes a control arm connected to said blade and extending in a generally longitudinal direction, said control arm being pivotably connected to said main frame about a generally vertical axis, and including a third hydraulic cylinder device having a first end pivotably connected to said main frame and a second end pivotably connected to said control arm, and means for controlling the application of pressurized hydraulic fluid to said third hydraulic cylinder device whereby the angular disposition of said grading blade is controlled.

6. A grading machine in accordance with claim 1 including means for turning said wheels about a generally vertical axis to steer said machine.

7. A grading machine comprising a main frame, a center frame, a rear frame, a grading blade connected to said main frame for pivoting motion about a generally vertical axis through a blade frame, said blade frame including a control arm having a first end pivotably connected to said main frame about said vertical axis and a portion spaced from said first end and slidably supported by a transverse across brace of said main frame, a first hydraulic cylinder device having a first end connected to said main frame and a second end pivotably connected to said arm for pivoting said arm about said vertical axis to adjust the angular disposition of said grading blade, a pair of spaced wheels rotatably carried by said main frame, means for steering said wheels, said center frame including a forward portion and a tubular member extending rearwardly therefrom, a pivot rod extending through apertures in said main frame and a hole in said forward portion of said center frame to pivotably connect said center frame to said main frame about a first generally horizontal axis, a second hydraulic cylinder device having a first end pivotably connected to said center frame and a second end pivotably connected to said main frame for adjusting the angular relationship between said center and main frames to adjust the height of said grading blade, said tubular member being rotatably coupled to said rear frame for rotation about a second generally horizonatal axis perpendicular to said first horizontal axis, a third hydraulic cylinder device having a first end pivotably connected to said rear frame and a second end pivotably connected to said center frame for rotating said tubular member and said center frame about said second axis to adjust the tilt of said grading blade, and means for controlling the supply of pressurized hydraulic fluid to said first, second and third hydraulic cylinder devices.

8. A grading machine comprising a main frame, a grading blade, means for connecting said grading blade to said main frame for pivoting motion about a vertical axis, means for moving said grading blade about said vertical axis, a rear frame, means for contacting the ground carried by said rear frame, means for connecting said rear frame to said main frame about two horizontal axes perpendicular to one another, said connecting means including a center frame, said center frame having a rearwardly extending tubular member, said rear frame including a hollow cylindrical member within which said tubular member is received for rotation about one of said horizontal axes, and a pivot rod extending through aligned holes in said main frame and a forward portion of said center frame in the direction of a second of said horizontal axes, means for vertically moving said main frame with respect of rear frame to adjust the height of said grading blade, and means independent of said vertical moving means for pivoting said main frame with respect to said rear frame about an axis generally in the direction of motion of the machine to adjust the tilt of said grading blade.

9. A grading machine in accordance with claim 8 wherein said blade connecting means includes a blade frame attached to said grading blade, said blade frame including a support member attached to and extending upward from said grading blade and a control arm extending from said support member, said control arm having a first end pivotable connected to said main frame and a distal portion slidably carried on a transverse member of said main frame.

10. A grading machine in accordance with claim 9 wherein said means for moving said grading blade about its vertical axis includes a hydraulic cylinder device having a first end pivotably connected to said main frame and a second end pivotably connected to said control arm.

11. A grading machine comprising a main frame, a grading blade, a blade frame for connecting said grading blade to said main frame for pivoting motion about a vertical axis, said blade frame including a support member attached to and extending upward from said grading blade and a control arm extending from said support member, said control arm having a first end pivotable connected to said main frame and a distal portion slidably carried on a transverse member of said main frame, means for moving said grading blade about said vertical axis including a hydraulic cylinder device having a first end pivotably connected to said main frame and a second end pivotably connected to said control arm, a rear frame, means for contacting the ground carried by said rear frame, means for connecting said rear frame to said main frame, means for vertically moving said main frame with respect of rear frame to adjust the height of said grading blade, and means independent of vertical moving means for pivoting said main frame with respect to said rear frame about an axis generally in the direction of motion of the machine to adjust the tilt of said grading blade.

12. A grading machine in accordance with claim 11 wherein said connecting means couples said rear frame to said main frame about two horizontal axes perpendicular to one another.

13. A grading machine in accordance with claim 12 wherein said connecting means includes a center frame, said center frame pivotably connected to said main frame about one of said horizontal axes and pivotally connected to said rear frame about the other of said horizontal axes.

14. A grading machine in accordance with claim 12 wherein said connecting means includes a center frame, said center frame having a rearwardly extending tubular member, said rear frame includes a hollow cylindrical member within which said tubular member is received for rotation about one of said horizontal axes, and a pivot rod extending through aligned holes in said main frame and a forward portion of said center frame in the direction of a second of said horizontal axes.

15. A grading machine in accordance with claim 14 wherein said means for pivoting said main frame with respect to said center frame to adjust the tilt of said grading blade includes a hydraulic cylinder device having a first end pivotably connected to said rear frame and a second end pivotably connected to said center frame for rotating said tubular member with respect to said cylindrical member.

16. A grading machine in accordance with claim 14 or 15 wherein said means for vertically moving said main frame includes a second hydraulic cylinder device having a first end pivotably connected to said center frame and a second end pivotably connected to said main frame for varying the angular relationship between said main and center frames about said pivot rod.

17. A grading machine in accordance with claim 15 wherein a lever arm extends outward from said tubular member and the pivotable connection at said second end of said hydraulic cylinder device is located on said lever arm a distance from the outer surface of said tubular member.

18. A grading machine in accordance with claim 8 or 11 wherein said ground contacting means includes a pair of wheels rotatably carried on an axle connected to said rear frame, said wheels being pivotable about vertical axes, and steering means for pivoting said wheels about their vertical axes.

19. A grading machine in accordance with claim 18 wherein said steering means includes a hydraulic cylinder device connected to a control rod for pivoting one of said wheels and a tie rod connected to a control rod for pivoting one of said wheels, and a tie rod connected to a control rod of the other wheel to pivot said wheels in unison.

* * * * *